US008808014B2

(12) United States Patent
Hsu et al.

(10) Patent No.: US 8,808,014 B2
(45) Date of Patent: Aug. 19, 2014

(54) PLUG CONNECTOR

(75) Inventors: Jung-Hui Hsu, New Taipei (TW); Chen-Teng Hsu, New Taipei (TW)

(73) Assignee: Powertech Industrial Co., Ltd., New Taipei (TW)

( * ) Notice: Subject to any disclaimer, the term of this patent is extended or adjusted under 35 U.S.C. 154(b) by 261 days.

(21) Appl. No.: 13/481,836

(22) Filed: May 27, 2012

(65) Prior Publication Data

US 2013/0065453 A1 Mar. 14, 2013

(30) Foreign Application Priority Data

Sep. 8, 2011 (TW) ..... 100132379 A

(51) Int. Cl.
*H01R 13/44* (2006.01)

(52) U.S. Cl.
USPC ..... 439/144; 439/133; 439/346; 439/373

(58) Field of Classification Search
USPC ..... 439/346, 373, 144, 133
See application file for complete search history.

(56) References Cited

U.S. PATENT DOCUMENTS

| | | | | |
|---|---|---|---|---|
| 1,771,757 | A | 7/1930 | Keeper | |
| 2,047,623 | A | 7/1936 | Felts | |
| 2,498,743 | A | 2/1950 | Theriault | |
| 2,546,201 | A | 3/1951 | Theriault | |
| 2,885,650 | A | 5/1959 | Miller | |
| 3,187,291 | A | 6/1965 | Hime | |
| 3,267,408 | A | 8/1966 | Baker | |
| 3,345,603 | A | 10/1967 | Cohen | |
| 3,390,404 | A | 6/1968 | Murchison | |
| 4,111,509 | A | 9/1978 | Novak | |
| 4,440,465 | A | 4/1984 | Elliott | |
| 4,526,433 | A | 7/1985 | Tanaka | |
| 4,544,216 | A | 10/1985 | Imhoff | |
| 4,605,273 | A | 8/1986 | Horton | |
| 5,082,450 | A | 1/1992 | Warren | |
| 5,194,013 | A | 3/1993 | Propp | |
| 5,249,976 | A | 10/1993 | Brock | |
| 5,480,318 | A | 1/1996 | Garrison | |
| 5,551,887 | A * | 9/1996 | Nankoh et al. | 439/188 |
| 6,039,591 | A | 3/2000 | Marsh | |
| 6,050,837 | A | 4/2000 | Duhe, Jr. | |
| 6,171,129 | B1 | 1/2001 | Philips | |
| 6,419,504 | B1 * | 7/2002 | Nelson | 439/103 |
| 6,595,810 | B1 | 7/2003 | Kenny | |
| 6,674,003 | B1 | 1/2004 | Torres | |
| 6,699,050 | B1 | 3/2004 | Wong | |

(Continued)

*Primary Examiner* — Truc Nguyen
(74) *Attorney, Agent, or Firm* — Li & Cai Intellectual Property (USA) Office

(57) ABSTRACT

The instant disclosure relates to a plug connector for inserting into at least one hole of an electrical outlet. The plug includes a plug body, a switch, a pushing member, at least one conductive member, and at least one locking member. The plug body is constructed of at least one shell defining a via hole, where the via hole penetrates entirely through the shell. The switch has a connecting end inserted through the via hole for connecting pivotally to the pushing member. The conductive member protrudes from the plug body, and the locking member is arranged in close to the conductive member. Thus, when the switch is operated, the connecting end is driven to push the pushing member to move with respect to the conductive member, and the locking member is pushed by the pushing member to deform or move.

14 Claims, 6 Drawing Sheets

(56) References Cited

U.S. PATENT DOCUMENTS

| | | | | |
|---|---|---|---|---|
| 7,041,918 | B1 * | 5/2006 | Wu | 200/51.09 |
| 7,104,818 | B1 * | 9/2006 | Chang | 439/140 |
| 7,175,463 | B2 | 2/2007 | Burton | |
| 7,347,703 | B2 * | 3/2008 | Gallardo | 439/144 |
| 7,465,180 | B2 * | 12/2008 | Kusuda et al. | 439/352 |
| 7,484,988 | B2 * | 2/2009 | Ma et al. | 439/350 |
| 7,652,210 | B2 | 1/2010 | White | |
| 2010/0003844 | A1 * | 1/2010 | Chen et al. | 439/350 |

* cited by examiner

PLUG CONNECTOR

BACKGROUND OF THE INSTANT DISCLOSURE

1. Field of the Instant Disclosure

The instant disclosure relates to a plug connector, in particular, to an electrical plug capable of preventing inadvertent withdrawal from a socket.

2. Description of Related Art

With the continuous advancement in technology, people are using more electronic devices and information technology (IT) products for personal or work related tasks. These products and devices are manufactured in different sizes and have different functions, however, they share a common characteristic: they are powered through cables or power cords either continuously while in use or in advance. Generally, the cables or power cords are inserted into a socket hole, either at home, in the factory, or in the office through a plug to receive electricity.

The conventional plug includes at least a pair of electrically conductive pins, and the socket has at least two matching holes for fitting the plug. To use the electronic devices, the pins are inserted into the holes to transmit electrical power. However, after the insertion, the plug may loosen or involuntarily detach from the socket due to reasons such as accidental pulling. This possibility may result in poor electrical connection or electrical disconnection.

Please refer to FIG. 6, which shows a schematic view of a plug 2 described in a U.S. patent (U.S. Pat. No. 6,039,591). As shown in FIG. 6, to address the aforementioned issue of inadvertent plug withdrawal, the U.S. Pat. No. 6,039,591 teaches the plug 2 which is engageable to a wall-type socket (not shown). The plug 2 comprises a plug body 28, a swage plate 27, and a shell 26. The plug body 28 includes a base 283, a pair of apertures 281, and a pair of electrically conductive blades 282. The swage plate 27 has a threaded portion 271 and a pair of swages (expanders) 272. The threaded portion 271 is arranged in the shell 26 and engaged to an inner threaded portion 261 of the shell 26. When the shell 26 is rotated by the user, the swage plate 27 is urged forward and rearward with respect to the plug body 28. When the swage plate 27 is impelled forward, the swages 272 are urged into the corresponding blades 282, thereby spreading the blades 282 within the socket. The friction fit provided between the expanded blades 4 and the socket prevents inadvertent plug withdrawal. However, such rotating method may result in the blades being over-tightened to the socket. Furthermore, this type of plug has a much more complicated manufacturing process that incurs a higher production cost.

Referring now to FIG. 7, which shows a schematic view of a safety plug described in another U.S. patent (U.S. Pat. No. 5,082,450). The safety plug comprises a ground prong 37. The ground prong 37 has a top surface 372 that defines an aperture 374. A lock spring 371 and an elongated locking bar 373 are received in the ground prong 37. When the bar 373 is moved to its forward position (shown in FIG. 7), the lock spring 371 is prevented from being deflected downwardly into the ground prong 37. Therefore, when the plug is inserted into the wall-type socket (not shown), the locking bar 373 prevents the ground prong 37 from being inadvertently separated from the socket. However, the lock spring 371 has a complex structure and is not easy to manufacture. The accommodation of the lock spring 371 in the ground prong 37 is also more difficult. When it is desired to disconnect the plug from the socket, the locking bar 373 is retracted to allow the lock spring 371 in returning to its original position. At its original position, the lock spring 371 does not extend upwardly through the aperture 374 in the top surface 372 of the ground prong 37. However, if the lock spring 371 gradually loses its elasticity due to prolonged utilization, the lock spring 371 may be unable to return to its original position due to elastic fatigue. This shortcoming can lead to the malfunction of the plug.

Thus, it is critical to research a simpler, faster, and more efficient method for preventing inadvertent plug withdrawal from the socket. More particularly, an improved method for preventing inadvertent separation of conductive blades from the socket.

SUMMARY OF THE INSTANT DISCLOSURE

The object of the instant disclosure is to provide a simple, fast and efficient method for preventing inadvertent plug withdrawal from the socket, more particular, for preventing inadvertent separation of the conductive blades from the socket.

In order to achieve the aforementioned object, an electrical plug is provided by the instant disclosure. The plug is insertable into at least one hole of an electrical outlet. The hole has a width H. The plug comprises at least one electrically conductive member, at least one locking member, and at least one pushing member. The locking member has a pressing end arranged close to the conductive member. The locking member is fixed to the conductive member. The pressing end has a first thickness H1. The pushing member is movable in a direction parallel to the conductive member. The pushing member has at least one extension of a second thickness H2. When the conductive member is inserted into the hole, the pressing end and the extension cooperatively establish a friction fit between the hole and the plug, where the following relationship exists: $H1+H2 \geq H$.

In order to achieve the aforementioned object, another plug is provided by the instant disclosure. The plug is engageable to at least one hole of an electrical outlet. The plug comprises a plug body, a switch, a pushing member, at least one electrically conductive member, and at least one locking member. The plug body defines a via hole and is constructed by at least one shell, where the via hole is penetrated entirely through the shell. A connecting end of the switch is inserted through the via hole to connect pivotally with the pushing member. The conductive member protrudes from the plug body, and the locking member is arranged in close to the conductive member. When the switch is operated by the user, the connecting end moves the pushing member with respect to the conductive member. Accordingly, the locking member is driven by the pushing member to move or deform.

Based on the above, the plug provided by the instant disclosure provides a simpler, faster and more efficient method for preventing inadvertent plug withdrawal from the socket, more particularly, preventing inadvertent separation of conductive members from the socket.

In order to further appreciate the characteristics and technical contents of the instant disclosure, references are hereunder made to the detailed descriptions and appended drawings in connection with the instant disclosure. However, the appended drawings are merely shown for exemplary purposes, rather than being used to restrict the scope of the instant disclosure.

DETAILED DESCRIPTION OF THE PREFERRED EMBODIMENTS

First Embodiment

Figure 1:
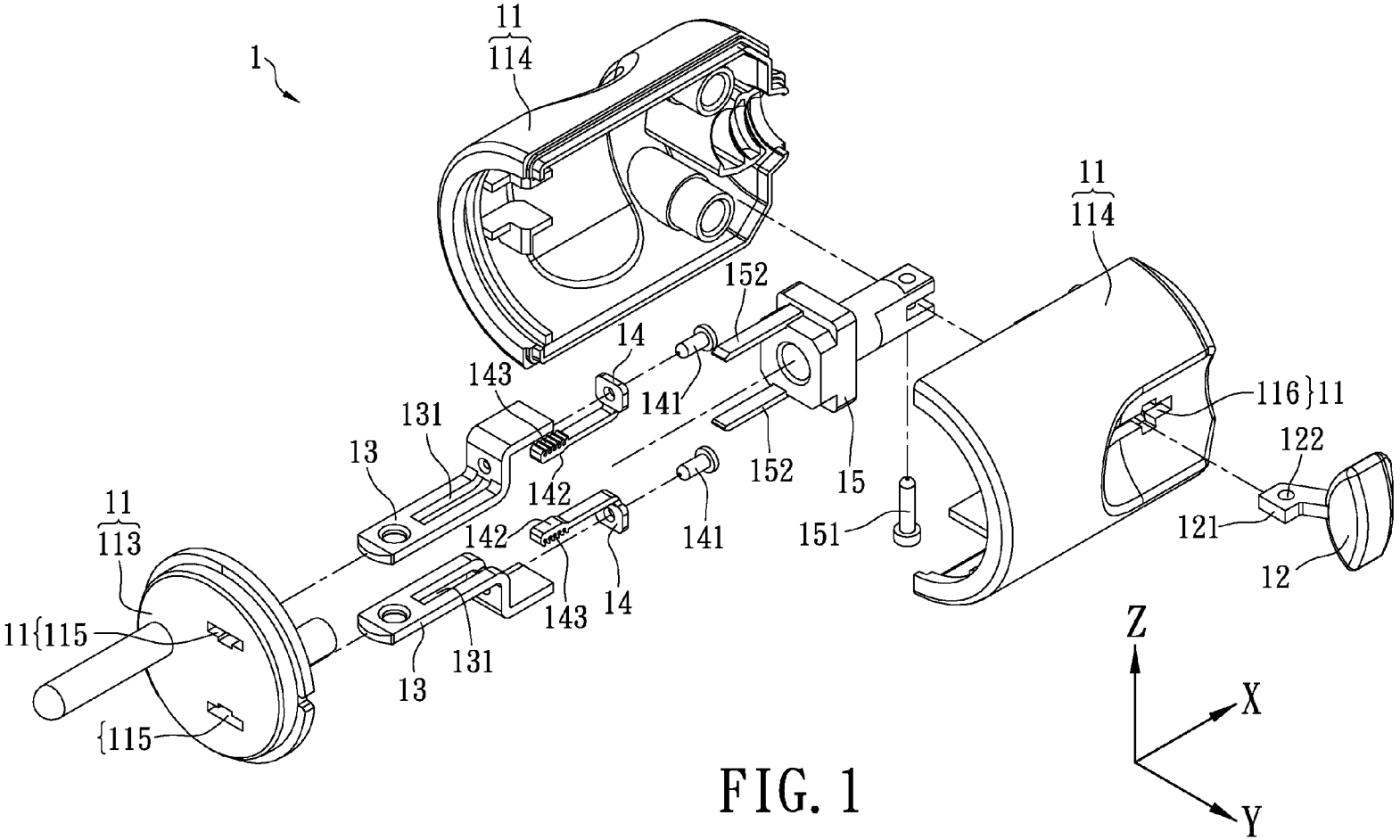
FIG. 1 shows an exploded view of a plug according to a first embodiment of the instant disclosure.

With reference to FIG. 1, which shows an exploded view of an electrical plug 1 according to a first embodiment of the instant disclosure. The plug 1 comprises a plug body 11, a switch 12, a pair of electrically conductive members 13, a pair of locking members 14, and a pushing member 15. The plug body 11 is constructed by a front plate 113 and a pair of shells 114. The front plate 113 defines a pair of through holes 115, while one of the shell 114 defines a via hole 116. The switch 12 has a connecting end 121 and a pivot hole 122 formed thereon, where the connecting end 121 is extended from the switch 12. Each of the locking members 14 is fitted with a pressing end 142 and a plurality of flexible locking structures 143, where the pressing end 142 extends from one side of the locking member 14. Each of the locking structures 143 takes the form of a substantially hook-like structure and is arranged on the pressing end 142. By the orientation of the figure, a pair of extensions 152 is protruded from the left side of the pushing member 15, where the extensions 152 extend along the direction of x-axis. It is worth noting that the front plate 113 and the shells 114 are separate components before assembling the plug 1. Furthermore, a cable (not shown) can be electrically connected to the right side of the conductive members 13. Each of the conductive members 13 defines a receiving slot 131 facing toward the z-axis. Moreover, in this embodiment, each receiving slot 131 is elongated along the x-axis.

When assembling the plug 1, the conductive members 13 are inserted into the respective through holes 115 along the x-axis to combine the conductive members 13 and the front plate 113. Next, the locking members 14 are inserted into the respective through holes 115 along the respective receiving slots 131. Then, the locking members 14 and the conductive members 13 are fixed to the front plate 113 by using a pair of screws 141. The pressing end 142 of each locking member 14 is arranged in close to the corresponding conductive member 13 and its receiving slot 131. Each of the locking members 14 and the corresponding conductive member 13 are fixedly disposed relative to one another.

Figure 2:
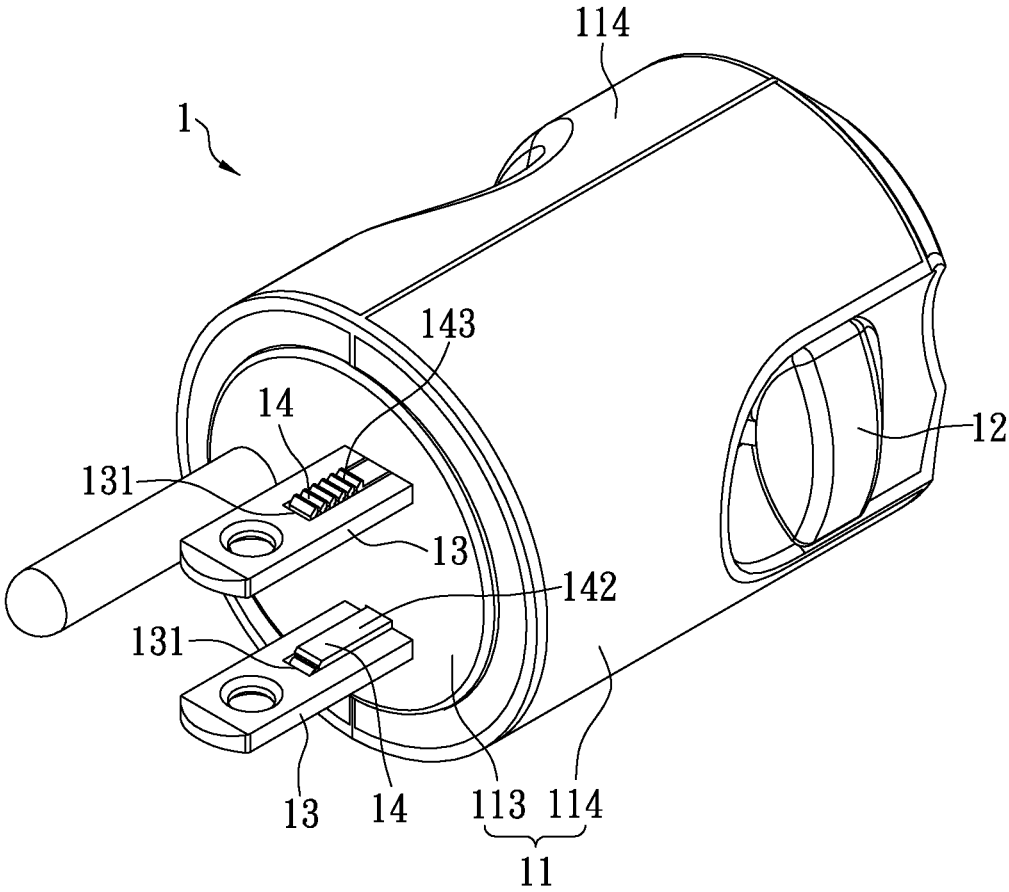
FIG. 2 shows an assembled view of the plug according to the first embodiment of the instant disclosure.

Next, the connecting end 121 of the switch 12 is passed through the via hole 116. A bolt 151 is inserted through the pushing member 15 and the pivot hole 122 for pivotally connecting the pushing member 15 and the connecting end 121 of the switch 12. As previously discussed, the screws 141 are utilized to fasten the locking members 14 and the conductive members 13 to the front plate 113. Then, the front plate 113 of the plug body 11 and the shells 114 are assembled together to enclose the pushing member 15 within the plug body 11. Having reference now to FIG. 2, the conductive members 13 protrudes from the front plate 113 of the plug body 11. The locking members 14 are arranged on the respective conductive members 13. More specifically, the pressing end 142 and the locking structures 143 of each locking member 14 are arranged in the receiving slot 131 of the respective conductive member 13 or adjacently thereto. The extensions 152 protrude into respective receiving slots 131. The locking members 14 can be made of a non-conductive material so as to simplify the manufacturing process. However, the locking members 14 can also be made of flexible materials such as plastic or rubber.

Figure 3A:
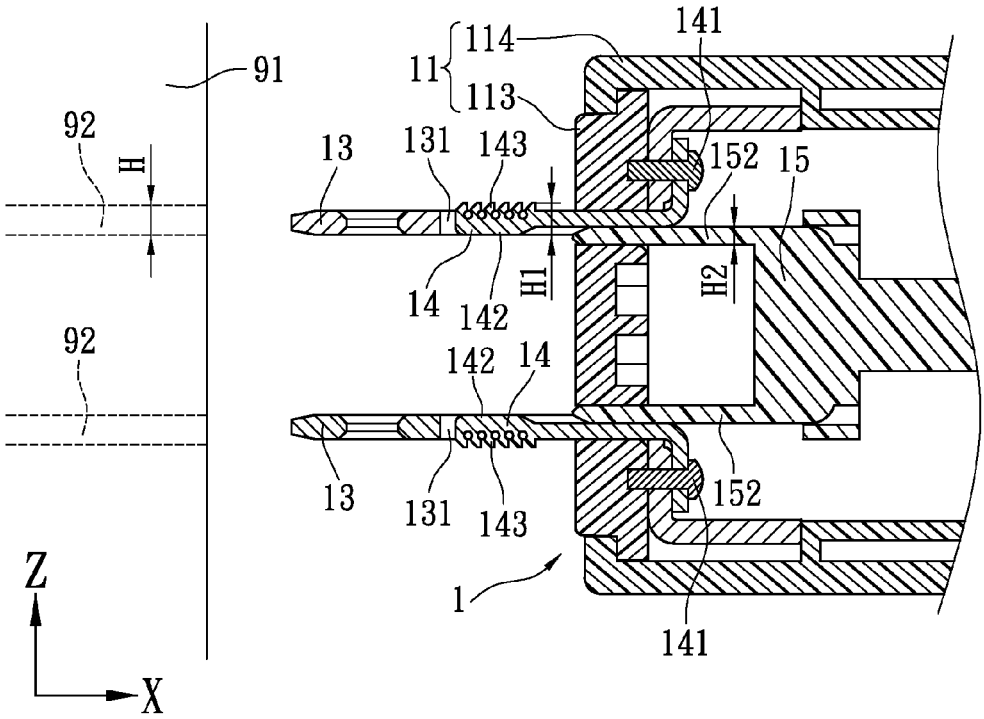
FIG. 3A~3B show the schematic views of the plug under operation according to the first embodiment of the instant disclosure.
Figure 3B:
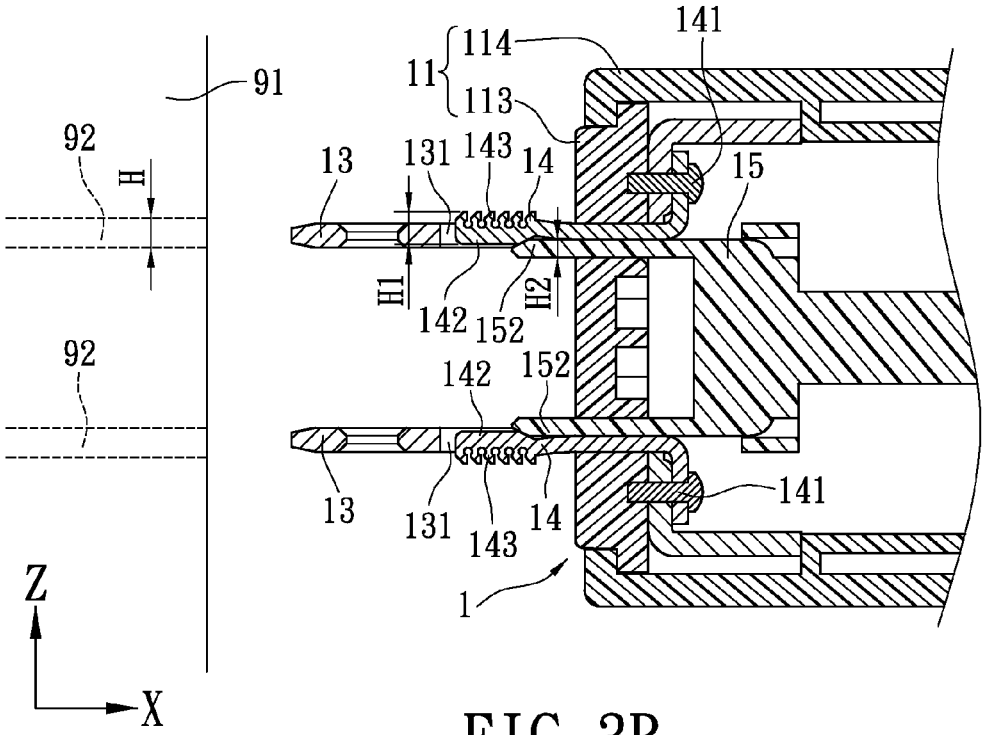

Please refer to FIGS. 3A~3B, which show the plug 1 while under operation. The plug 1 is insertable into a pair of holes 92 of a socket mounted on a wall 91. When the switch 12 is operated by the user, the pushing member 15 is urged by the connecting end 121 and moves with respect to the conductive members 13. The locking members 14 are then pushed by the pushing member 15. Specifically, the pushing member 15 is capable of being moved forward and backward by the switch 12. Since the conductive members 13 are fixed to the front plate 113 of the plug body 11, the pushing member 15 can impel the locking members 14 to move forward and backward along the x-axis. For the instant embodiment, when the pushing member 15 moves, the switch 12 will pivot slightly about the bolt 151. Furthermore, the extensions 152 are abutted to the respective locking members 14. More specifically, when the extensions 152 are moved forward, the pressing end 142 and the locking structures 143 of each locking member 14 are pushed by the corresponding extension 152 in moving toward a direction along the z-axis. In other words, the forward end (i.e., the pressing end 142) of each locking member 14 is forced to move in a transverse direction. This transverse movement is shown in FIG. 3B and defined along the z-axis. For referential purposes, the inserting direction of the conductive members 13 into the holes 92 is along the x-axis, while the moving direction of the pressing ends 142 and the locking structures 143 are along the z-axis. In other words, the inserting direction of the conductive members 13 and the moving direction taken by the pressing ends 142 are perpendicular to one another. Specifically, the extensions 152 of the pushing member 15 move in a direction along the x-axis inside the respective receiving slots 131 or adjacently thereto. When the pushing member 15 abuts the locking members 14, the extensions 152 will push the pressing end 142 and the locking structures 143 of each locking member 14 to move transversely.

With reference to FIG. 3B, each of the holes 92 has a width H. Each of the pressing ends 142 has a first thickness H1, and each of the extensions 152 has a second thickness H2. The pushing member 15 can move in a direction parallel to the conductive members 13. After the pressing end 142 and the locking structures 143 of each locking member 14 have moved transversely, the sum of the first thickness H1 and the second thickness H2 is greater than the width H, namely $H1+H2 \geq H$. Therefore, when the conductive members 13 of the plug connector 1 are inserted into the holes 92, the pressing end 142 of each locking member 14 and the corresponding extension 152 will establish a friction fit with the respective hole 92. Thus, the friction fit provided between the holes 92 and the locking members 14 can be enhanced through a slight deformation of the locking structures 143 to prevent inadvertent withdrawal of the conductive members 13 from the holes 92. In other words, the frictional force exerted by the locking structures 143 to the holes 92 enables the prevention of inadvertent plug withdrawal from the socket. Thus, the instant disclosure provides a simpler, faster and more efficient method for preventing inadvertent plug withdrawal from the socket, more particularly, for preventing the withdrawal of conductive members from the holes of the socket.

Second Embodiment

Figure 4A:
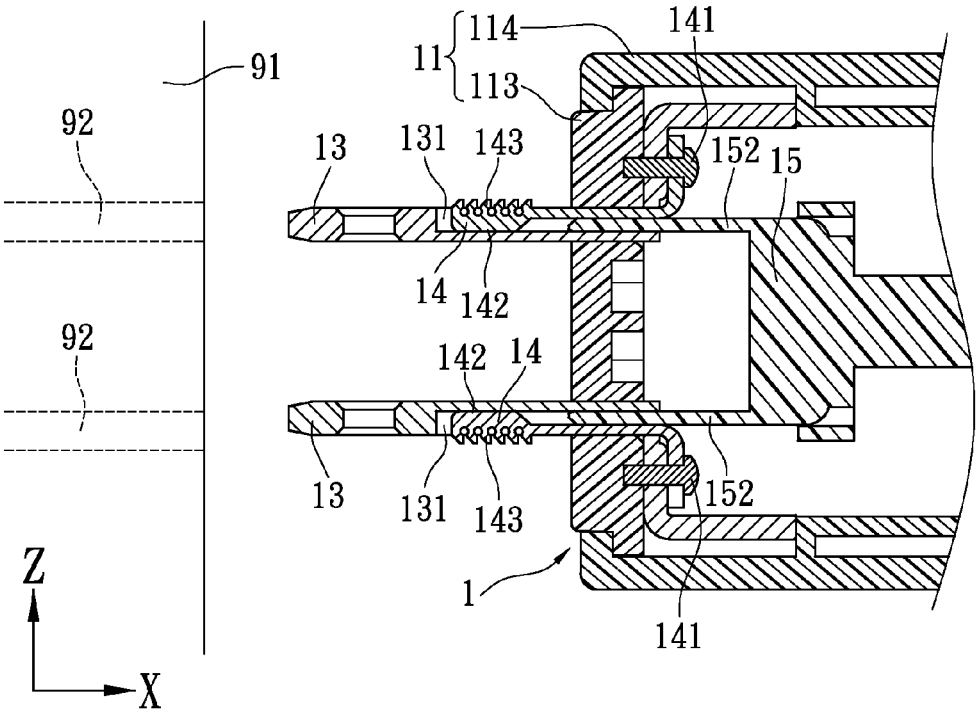
FIG. 4A~4B show the schematic views of the plug under operation according to a second embodiment of the instant disclosure.
Figure 4B:
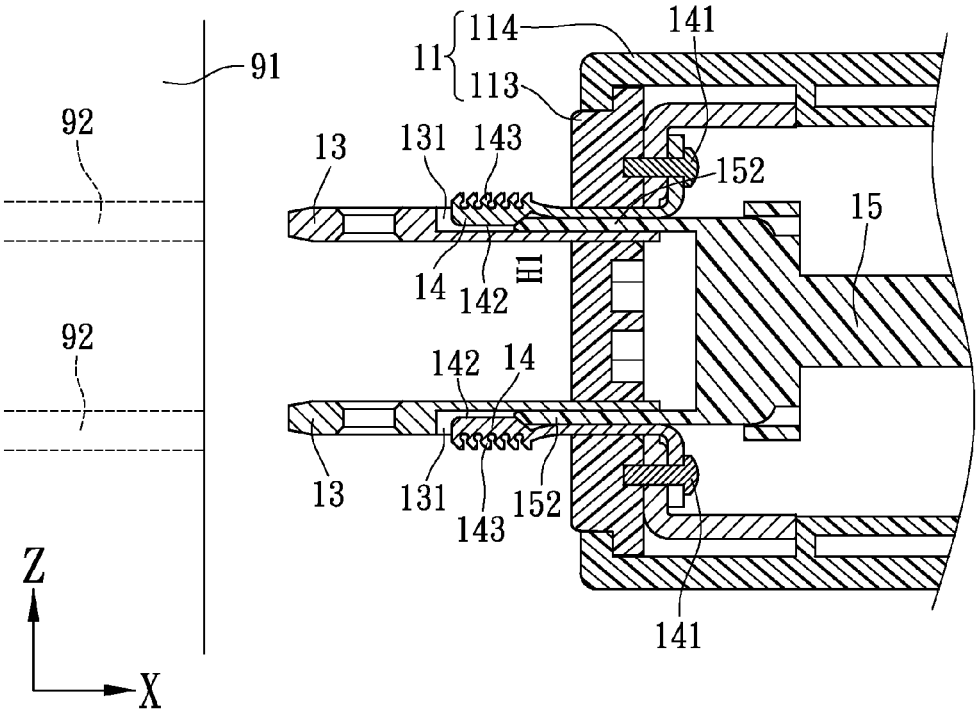

Another embodiment of the instant disclosure is provided herein. Please refer to FIGS. 4A~4B, which show the plug 1 under operation according to a second embodiment of the instant disclosure. For the following descriptions, like components are given the same numerals and no further elaborations regarding the structural configurations and position thereof will be described herein. With reference to FIGS. 4A~4B, each of the receiving slots 131 of the instant embodiment is a trough concavely formed on the respective conductive member 13. In other words, each of the receiving slots 131 does not penetrate through the corresponding conductive member 13 along the z-axis.

After the plug 1 has been assembled, one of the receiving slots 131 faces upwardly, while the other receiving slot 131 faces downwardly and the pressing ends 142 are received in the respective receiving slots 131. Next, with reference to FIG. 4B, if the pushing member 15 is moved forward (leftward direction in the figure), the pressing ends 142 will be pushed by the respective extensions 152 to move in opposite direction along the z-axis. Thus, a friction fit is provided between the conductive members 13 and the holes 92 through the locking structures 143 arranged on each pressing end 142. Thereby, the plug 1 is enabled to engage firmly to the socket. The advantage of the trough-like receiving slots 131 is this: when the conductive members 13 are inserted into the holes 92, the pressing ends 142 will not oscillate intensely in the upward and downward directions (i.e., along the z-axis) while being pressed by the holes 92 to increase stability.

For the instant embodiment, the receiving slots 131 are partially exposed from the plug body 11. However, for other embodiments of the instant disclosure, the receiving slots 131 can be entirely exposed from the plug body 11.

Third Embodiment

Figure 5A:
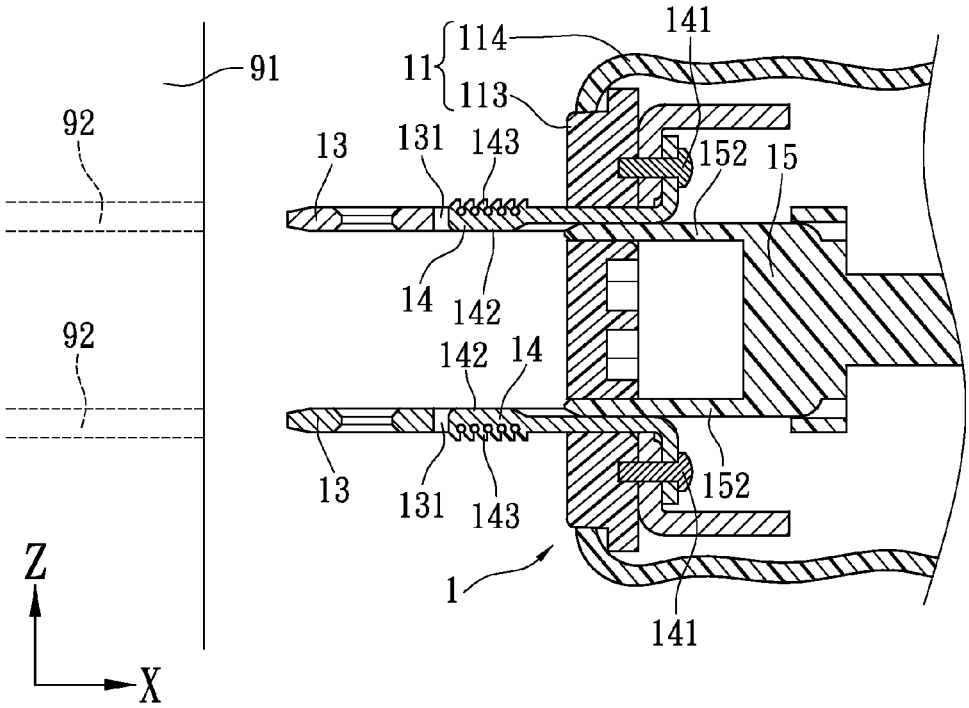
FIG. 5A~5B show the schematic views of the plug under operation according to a third embodiment of the instant disclosure.
Figure 5B:
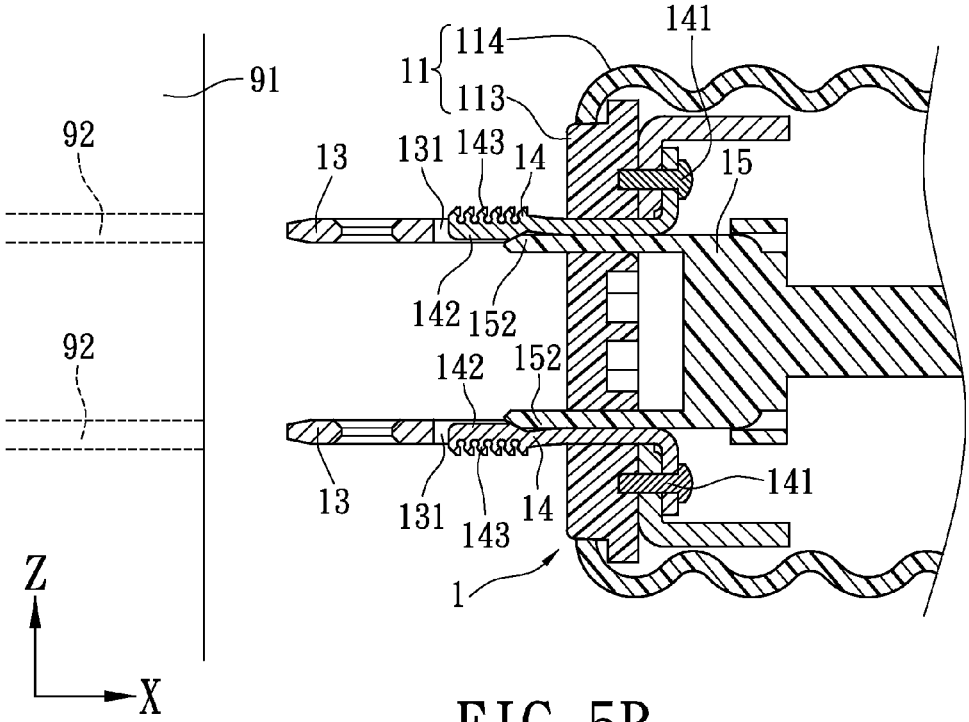
Figure 6:
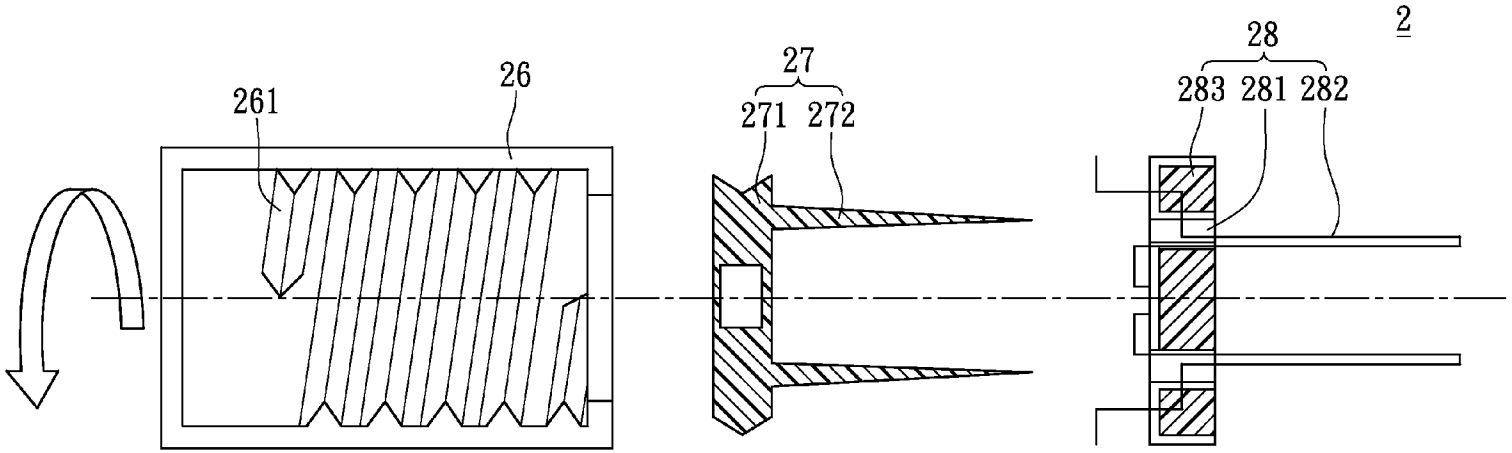
FIG. 6 PRIOR ART
FIG. 6 shows a schematic view of a plug taught by the U.S. Pat. No. 6,039,591.
Figure 7:
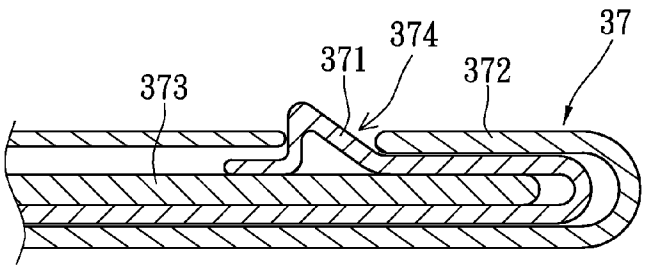
FIG. 7 PRIOR ART
FIG. 7 shows a schematic view of a ground prong of a safety plug taught by the U.S. Pat. No. 5,082,450.

Having reference now to FIGS. 5A~5B, which show the plug 1 in operation according to a third embodiment of the instant disclosure. For the instant embodiment, the plug 1 is structurally similar to the first embodiment (i.e., FIGS. 3A~3B), with the difference being the shells 114 of the plug body 11 are flexible and resilient. The resilient shells 114 enable the pushing member 15 to move forward and backward along the x-axis. For this embodiment, the shells 114 take the form of a substantially wave-shaped structure and are flexible. The shells 114 are capable of contracting and temporarily deforming in a direction along the x-axis. More specifically, through the deformation of the shells 114, the total length of the plug body 11 along the x-axis is changed. Next, the pushing member 15 is pushed by the shells 114 to move in a direction along the x-axis. Accordingly, the locking members 14 are pushed by the pushing member 15 also along the x-axis to achieve the prevention of inadvertent plug withdrawal.

Based on the above, the plug of the instant disclosure provides a faster and more efficient method for preventing inadvertent plug withdrawal and increasing secure electrical connection between the conductive members and the holes.

The descriptions illustrated supra set forth simply the preferred embodiments of the instant disclosure; however, the characteristics of the instant disclosure are by no means restricted thereto. All changes, alternations, or modifications conveniently considered by those skilled in the art are deemed to be encompassed within the scope of the instant disclosure delineated by the following claims.

What is claimed is:

1. An electrical plug, for engaging at least one hole of a socket, with each hole having a width H, comprising:

at least one conductive member;

a least one locking member having a pressing end of a first thickness H1 and fixedly arranged to the corresponding conductive member; and a pushing member capable of moving parallelly with respect to the corresponding conductive member, the pushing member having at least one extension with each extension of a second thickness H2;

wherein when the conductive member is inserted into the hole, the pressing end and the extension cooperatively establish a friction fit between the hole and the conductive member with $H1+H2 \geq H$.

2. The electrical plug of claim 1, further comprising a plug body, wherein one end of the pushing member is connected to the plug body.

3. The electrical plug of claim 2, wherein the plug body is flexible and resilient for pushing the pushing member.

4. The electrical plug of claim 1, wherein the conductive member has a receiving slot formed thereon for accommodating the locking member.

5. The electrical plug of claim 4, wherein the pushing member is capable of moving within or close to the receiving slot for pushing the locking member.

6. The electrical plug of claim 4, wherein the receiving slot penetrates entirely through the conductive member.

7. The electrical plug of claim 4, wherein the receiving slot is concavely formed on the conductive member.

8. The electrical plug of claim 1, wherein the locking member has a plurality of flexible locking structures, and when the conductive member is inserted into the hole, a friction fit is selectively established between the locking structures and the hole.

9. An electrical plug for engaging at least one hole of a socket, comprising:

a plug body defining a via hole and constructed of at least one shell, wherein the via hole is penetrated through the shell;

a switch having a connecting end, wherein the connecting end is inserted through the via hole;

a pushing member pivotally connected to the connecting end;

at least one electrically conductive member protruding from the plug body;

at least one locking member arranged in close to the conductive member;

wherein the switch is operable to move the pushing member through the connecting end, in allowing the pushing member to move respect to the conductive member and engage the locking member to generate a movement or temporary deformation for the locking member.

10. The electrical plug of claim 9, wherein one end of the pushing member is received in the plug body.

11. The electrical plug of claim 10, wherein the plug body is flexible and resilient for moving the pushing member.

12. The electrical plug of claim 9, wherein the conductive member defines a receiving slot external of the plug body for receiving the locking member.

13. The electrical plug of claim 12, wherein the receiving slot is concavely formed on the conductive member or penetrated entirely through the conductive member.

14. The electrical plug of claim 9, wherein the locking member has a plurality of flexible locking structures, and when the conductive member is inserted into the hole, a friction fit is selectively established between the locking structures and the hole.

* * * * *